US007938617B2

(12) United States Patent
Naruse et al.

(10) Patent No.: US 7,938,617 B2
(45) Date of Patent: May 10, 2011

(54) PRESSURE TEST METHOD OF DOUBLE SUCTION VOLUTE PUMP

(75) Inventors: Tomohiro Naruse, Hitachinaka (JP); Hideki Akiniwa, Tsuchiura (JP); Hiroaki Yoda, Tsuchiura (JP); Minoru Hiroshima, Ushiku (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 558 days.

(21) Appl. No.: 11/599,488

(22) Filed: Nov. 15, 2006

(65) Prior Publication Data

US 2007/0116558 A1 May 24, 2007

(30) Foreign Application Priority Data

Nov. 16, 2005 (JP) ..... 2005-331027

(51) Int. Cl.
*F04D 29/00* (2006.01)

(52) U.S. Cl. ..... 415/118; 415/102

(58) Field of Classification Search ..... 415/205, 415/102, 101, 118; 73/37, 700, 714
See application file for complete search history.

(56) References Cited

U.S. PATENT DOCUMENTS

| | | | | |
|---|---|---|---|---|
| 2,971,468 | A * | 2/1961 | McDoniel | 415/97 |
| 4,383,800 | A * | 5/1983 | Becker et al. | 415/204 |
| 4,563,124 | A | 1/1986 | Eskew | |

FOREIGN PATENT DOCUMENTS

| | | | |
|---|---|---|---|
| JP | 7-318449 | A | 12/1995 |
| JP | 8-28486 | A | 1/1996 |
| JP | 11-236894 | A | 8/1999 |
| JP | 11-303789 | A | 11/1999 |
| JP | 2003-184786 | A | 7/2003 |

OTHER PUBLICATIONS

Double Suction Volute Pumps,; B 8322-1995 pp. 318-333 with Partial Translation.

*American National Standard for Centrifugal Pumps for Nomenclature, Definitions, Application and Operation*, Hydraulic Institute, 1994, Parsippany, New Jersey, cover page, title page, index page I, and pp. 110-111.

* cited by examiner

*Primary Examiner* — Edward Look
*Assistant Examiner* — Dwayne J White
(74) *Attorney, Agent, or Firm* — Crowell & Moring LLP

(57) ABSTRACT

According to the present invention, along the right and left sides of a rotary shaft, flat faces that serve as sealing faces are formed at the circumferential edges, on the suction chamber side, of semicircular division plates, which define suction chambers and a discharge chamber of a volute casing that is divided into two segments. Two disc plates are prepared as pressure test tools, and are positioned on the right and left sides of the rotary shaft so that they contact the flat faces that are formed around the circumferential edges of the division plates near the suction chambers. The two disc plates are then securely connected to a member in the axial direction. In addition, a bolt fastening structure, which is axially tightened by the member that connects the disc plates axially, is provided in at least one axial direction.

13 Claims, 7 Drawing Sheets

PRIOR ART

PRESSURE TEST METHOD OF DOUBLE SUCTION VOLUTE PUMP

BACKGROUND OF THE INVENTION (1) Field of the Invention

The present invention relates to a pressure test apparatus for a double suction volute pump.

(2) Description of Related Art

Pressure tests are required for pressure vessels such as pump casings.

The following is a pressure test designed for a conventional storage pump to confirm that, under test conditions, the casing of the pump will not be destroyed and there will be no leakage of water. First, water is sealed within the casing of the pump, and then, the pressure in the casing is increased until it is about one and a half times as high as a discharge pressure (a shutoff pressure) for a zero-discharge operation.

A similar pressure test is also performed for the volute casing of a double suction volute pump. To prepare for the test, bolts are inserted through holes in flanges on upper and lower volute casing assembly sections, and O rings are sandwiched between the upper and lower volute casing, and the bolts are tightened to secure the upper to the lower volute casing. Then, to seal the thus prepared volute casing, a suction port, a discharge port, shaft seal parts and other ports are tightly closed, and a port through which water is to be introduced is prepared. Thereafter, for the test, water is introduced and the water pressure is increased until one and a half times as high as the shut-off pressure in both a suction chamber and a discharge chamber. Thus, the casing thickness for the suction chamber must be greater than that for the discharge chamber in order to withstand the test pressure because the suction chamber has the larger volume.

Patent Document 1: JP-A-7-318449
Patent Document 2: JP-A-8-28486
Patent Document 3: JP-A-11-236894
Patent Document 4: JP-A-11-303789
Patent Document 5: JP-A-2003-184786
Non-patent Document 1: JIS B8322

BRIEF SUMMARY OF THE INVENTION

As to the above described conventional example, for a double suction volute pump, since the upper and lower division walls that divide the suction chambers and the discharge chamber may be deformed by bending, it is difficult to seal between the sealing of these chambers. And it is difficult that pressure test is performed using different pressures for suction and for discharge. Therefore, conventionally, the same pressure is employed for suction and discharge during a test, and the volute casing on the suction chamber sides must be thicker than that required for normal operation.

Thus, one objective of the present invention is to provide a pressure test apparatus for a double suction volute pump that can appropriately seal between the suction chamber and the discharge chamber, and that can perform a pressure test using different pressures for suction and discharge, while preventing the deformation due to bending of upper and lower division walls.

To achieve this objective, there is provided a pressure test apparatus for a double suction volute pump, which includes a horizontally arranged rotary shaft, a double suction centrifugal type impeller, and a volute casing for enclosing the impeller, and whose casing has suction chambers and a discharge chamber, and whose impeller taking fluid from both axial directions of the rotary shaft and discharging the fluid to a radial and outer peripheral direction. The pressure test apparatus can conduct a pressure test applying a high pressure to the discharge chamber by forming flat faces on the sides of the suction chambers, and by blocking off each chamber with division walls, and by fixing the division walls to the flat faces.

Further, to achieve the above objective, the division plates formed in the suction chambers are connected by using members.

Furthermore, to achieve the objective, the members are bolts, which penetrate the discharge chamber.

Additionally, to achieve the objective, ring-shaped grooves are formed in the flat faces formed on the division walls, and sealing members are inserted into the grooves.

Moreover, to achieve the objectives, the division walls are fixed to the flat faces by screws.

According to the present invention, a pressure test apparatus, for a double suction volute pump, can appropriately seal the suction chambers and the discharge chamber, can prevent bending deformation of the upper and lower division plates, and can perform the pressure test using different pressures for suction and discharge.

Other objects, features and advantages of the invention will become apparent from the following description of the embodiments of the invention taken in conjunction with the accompanying drawings.

DETAILED DESCRIPTION OF THE INVENTION

A conventional double suction volute pump will be described with reference to FIGS. 2, 3 and 4.

Figure 2:
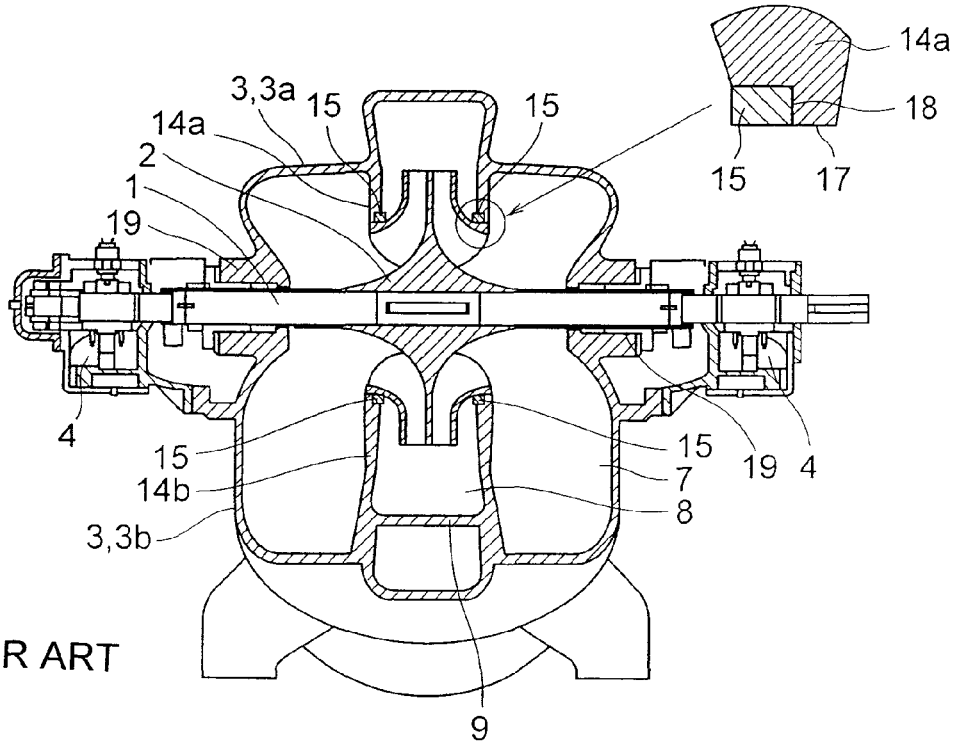
FIG. 2 is a cross-sectional view of a conventional double suction volute pump.

FIG. 2 is a cross-sectional view of a conventional double suction volute pump. FIG. 3 is a front view of the conventional double suction volume pump. And FIG. 4 is a cross-sectional view of the conventional double suction volute pump, taken perpendicularly along the axis.

Figure 3:
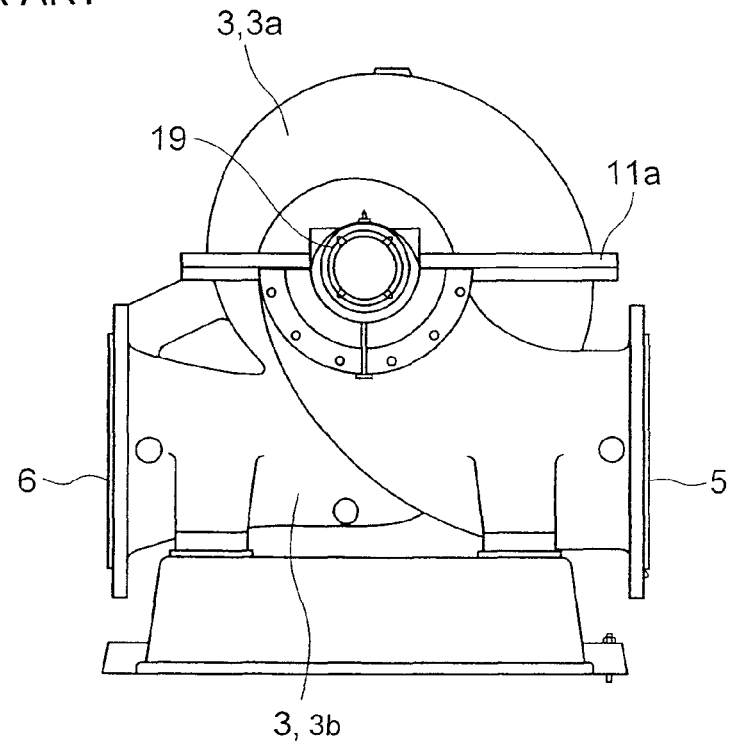
FIG. 3 PRIOR ART
FIG. 3 is a front view of the conventional double suction volute pump.
Figure 4:
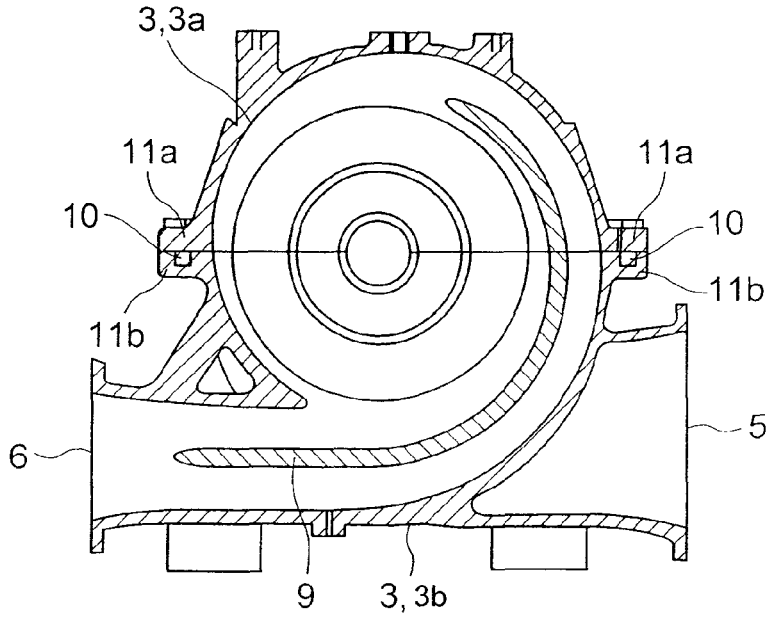
FIG. 4 PRIOR ART
FIG. 4 is a cross-sectional view of the conventional double suction volute pump taken perpendicular to the axis.

As shown in FIGS. 2 to 4, a conventional double suction volute pump includes: a rotary shaft (a main shaft) 1, arranged horizontally; an impeller 2, which is fixed to the rotary shaft 1; a volute casing 3, which encloses the impeller 2 and forms a flow path for fluid; and a bearing part 4, which is fixed to the casing to support the rotary shaft 1. The impeller 2 draws fluid from both sides of the rotary shaft 1, in the axial direction, and while rotating, discharges the fluid in the radial outer peripheral direction, so as to increase the pressure of the fluid. The volute casing 3 has a complicated shape and, has two volute constituents of suction chambers 7 and a discharge chamber 8, as shown in FIGS. 3 and 4. Along the casing, low-pressure fluid is introduced through a suction port and guided to the impeller 2, and then, the fluid is pressurized and discharged by the impeller 2 and guided to a discharge port 6.

There are two types of discharge chambers 8, a double volute type, wherein a stay vane 9 is provided, and a single volute type, wherein a stay vane 9 is not provided, the volute casing 3 is divided into two segments along the rotary shaft 1, so that the rotary shaft 1 and the impeller 2 are enclosed. The volute casing 3 shown in FIGS. 2 to 4 is formed of an upper casing 3*a* and a lower casing 3*b*. The impeller 2, the rotary shaft 1 and the bearing part 4 are mounted in the lower casing 3*b*. Then, the upper casing 3*a* is mounted on the lower casing 3*b* so that the O rubber rings 10 (shown in FIG. 4) are sandwiched between the lower flange 11*b* and the upper flange 11*a*. The casings 3*a* and 3*b* are then secured in place by using bolts to fasten the upper flange 11*a* to the lower flange 11*b*.

An arrangement wherein a casing is divided into upper and lower casings 3*a* and 3*b* is referred to as a horizontal division. As another arrangement that may be employed, a casing is divided vertically into a suction port 5 side segment and a discharge port side segment 6. Casing wearing rings (or mouth rings) 15 (see FIG. 2) are attached between the volute casing 3 and the impeller 2, so that the impeller 2 slides within a gap between the casing wearing rings 15, and the low pressure fluid on the suction chamber 7 side is sealed off from the high pressure fluid on the discharge chamber 8 side. Because the wearing rings are pushed from the high pressure discharge side, the casing wearing rings 15 are attached so that they contact flat surfaces 18 at circumferential edges 17 of upper and lower semicircular division plates 14*a* and 14*b*, which serve as partitions between the suction chambers 7 and the discharge chamber 8.

A pressure test is required for a pressure vessel, such as a pump casing.

Especially, for a conventional water pump, when about one and a half times as high as the discharge pressure (or the shut-off pressure), it is required that the casing not be destroyed and that water leakage not occur. Likewise, for a double suction volute pump, the upper and lower volute casings 3*a* and 3*b* are secured in place by sandwiching O rings 10 between the upper and lower flanges 11*a* and 11*b* using bolts, and the resultant casing 3 is completely sealed by closing the suction port 5, the discharge port 6, shaft seal parts 19 and other ports, water is introduced into the sealed casing, and the water pressure is increased until about one and a half times as high as the shut-off pressure when the pressure test is conducted. In this case, the same pressure is employed for the test for the suction chamber 7 side and the discharge chamber 8 side. When the pressure test is performed using the same pressure for suction and discharge, the thickness of the casing on the suction chamber 7 side must be greater than the thickness required for actual operation because the volume of the suction chamber is larger and the suction chamber side must withstand the pressure.

During actual operation, the pressure in the suction chambers 7 is low and the pressure in the discharge chamber 8 is high. There is another test method that likewise employs different pressures for suction and discharge. According to this method, to provide the same pressure state as in actual operation during a pressure test, the suction chamber 7 is pressurized one and a half times as high as the suction pressure or the lowest pressure, the discharge chamber 8 is pressurized about one and a half times as high as the shut-off pressure in pressure text. In order to perform a pressure test employing different pressures for suction and discharge, the suction chambers 7 and the discharge chamber 8 must be separated by employing, disc shaped jigs 12 that block, from the discharge chamber 8 side, circular holes into which the impeller 2 is inserted as shown in FIG. 5, or by inserting a cylindrical jig 13 at locations where the impeller 2 is positioned as shown in FIG. 6.

Figure 5:
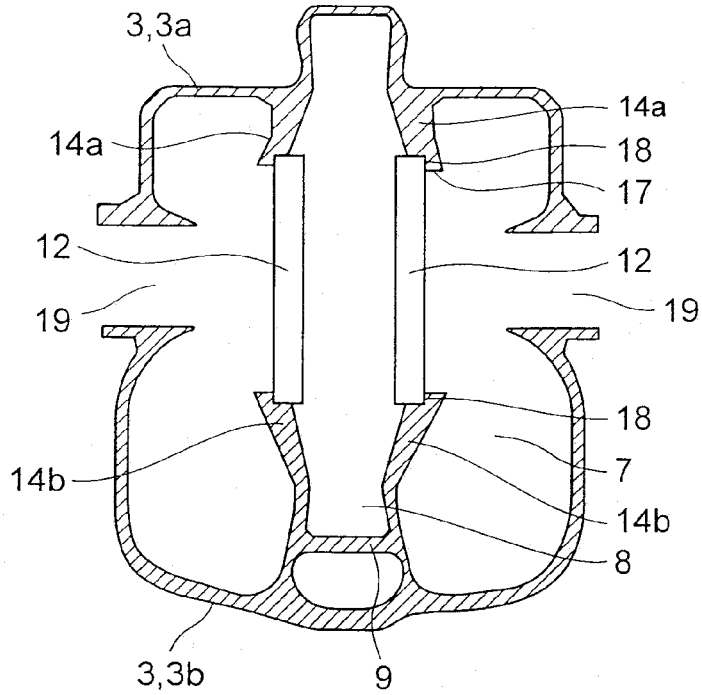
PRIOR ART FIG. 5
FIG. 5 is a cross-sectional view for explaining a pressure test method to be conducted for the conventional double suction volute pump using different pressures for suction and discharge.
Figure 6:
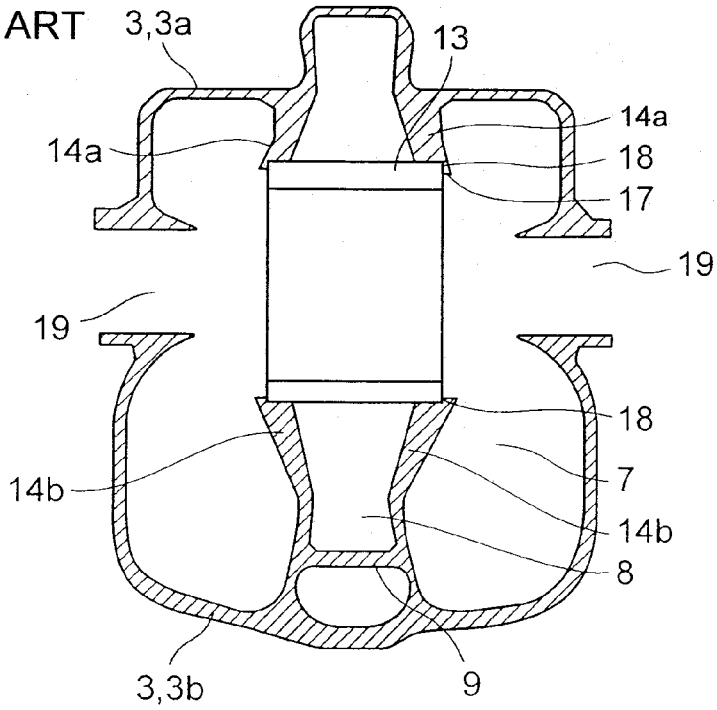
FIG. 6 PRIOR ART
FIG. 6 is a cross-sectional view for explaining the pressure test method to be conducted for the conventional double suction volute pump using different pressures for suction and discharge.

For the disc shaped jigs 12 in FIG. 5 or the cylindrical jigs 13 in FIG. 6, the flat faces 18, which are formed along the circumferential edges 17 of the division plates 14*a* and 14*b* and are used to fix the casing wearing rings 15, are employed as sealing surfaces. When the pressure test is performed using different pressures for suction and discharge, the ratio of the pressures on the suction chamber 7 side and on the discharge chamber 8 side becomes substantially equal to the ratio during actual operation. Thus, the thickness of the casing on the suction chamber 7 side can be set based on the actual operation condition, and is very much reduced compared with when the pressure test is performed using the same pressure for suction and discharge.

Figure 7:
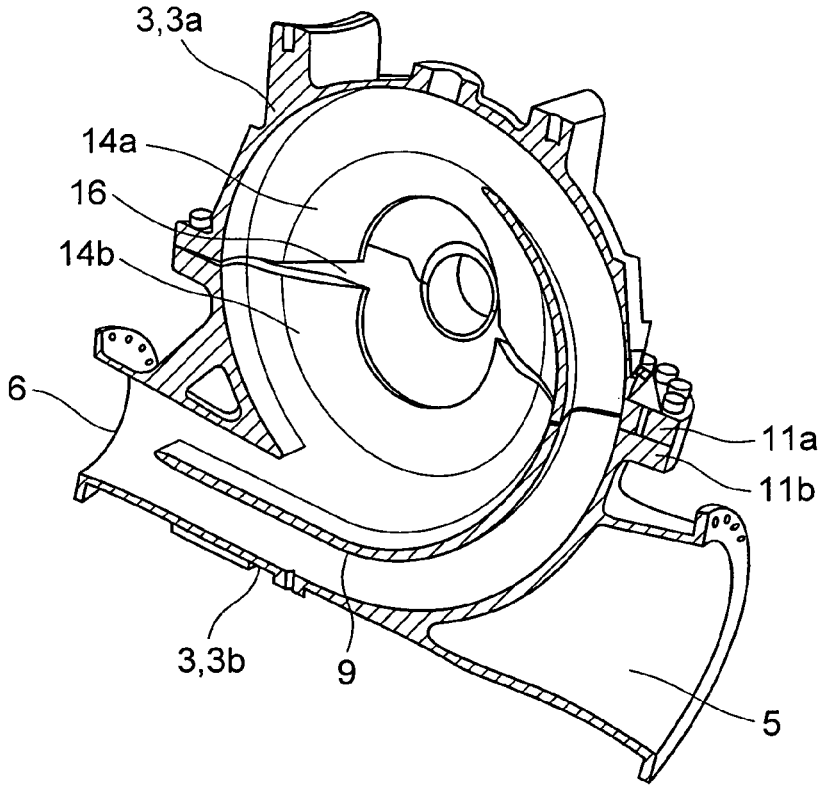
FIG. 7 is a perspective view showing a deformation of the general double suction volute pump as the result of the pressure test that uses different pressures for suction and discharge.

However, as shown in FIG. 7 (a perspective view showing example casing deformation that occurred as a result of a pressure test conducted using different pressures for suction and discharge), it was found that since between the suction chamber 7 side and the upper and lower semicircular division plates 14*a* and 14*b*, which separate the suction chambers 7 from the discharge chamber 8, deform towards the suction chambers 7 since there was a large pressure difference between the suction chamber 7 side and the discharge chamber 8 side. Therefore, especially for a model having a large pump head, i.e., a model wherein the shut-off pressure is high, because of bending deformation of the upper and lower division plates 14*a* and 14*b*, even though the disc shaped jig 12 in FIG. 5 was, or the cylindrical jig 13 in FIG. 6 was employed, high pressure fluid in the discharge chamber 8 leaked into the suction chambers 7 through gaps 16 that is formed at openings 17 in the upper and lower division plates 14*a* and 14*b*. That is why the sealing between the suction chambers 7 and the discharge chamber 8 is difficult for a pressure test using different pressures for suction and discharges, and therefore this test has not generally been employed. The above described problem occurs not only in the horizontally divided volute casing in FIG. 7, but also in a vertically divided volute casing.

In detail, in a double suction volute pump, nevertheless a high pressure is actually applied only to the discharge side in actual operating condition, when a pressure test is performed, since water pressure is applied to the entire internal area of the volute casing, the thickness of the casing on the suction side must be increased to withstand the pressure.

For a double suction volute pump, the applicants have been studied various pressure test apparatuses to prevent the bending deformation of the upper and lower division plates, and to appropriately seal the suction chambers and the discharge chamber and enable a pressure test to be performed that uses different pressures for suction and discharge.

The preferred embodiments of the present invention will now be explained while referring to the accompanying drawings.

Embodiment 1

Figure 1:
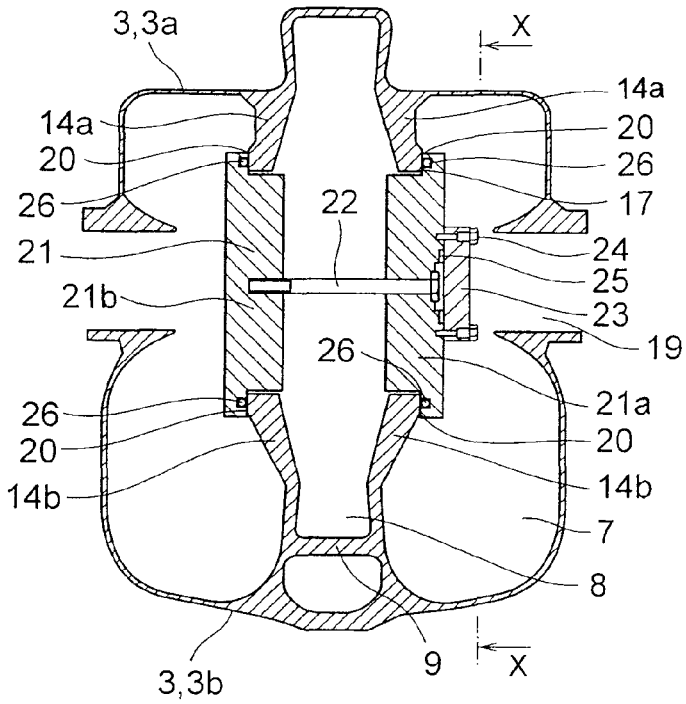
FIG. 1 is a cross-sectional view of the casing of a double suction volute pump for explaining Embodiment 1 of the present invention.

FIG. 1 is a cross-sectional view of a casing constituting a double suction volute pump according to embodiment 1 of the present invention.

In FIG. 1, semicircular disciform division plates 14*a* and 14*b* divide the suction chambers 7 and the discharge chamber 8 of the upper and lower volute casing 3*a* and 3*b*. The interior of upper and lower volute casings 3*a* and 3*b* together form a casing 3. Flat faces 20 that serve as sealing faces are formed at circumferential edges 17 of the division plates 14*a* and 14*b* on the side of the suction chambers 7 and along the right and left sides of the rotary shaft.

Figure 8:
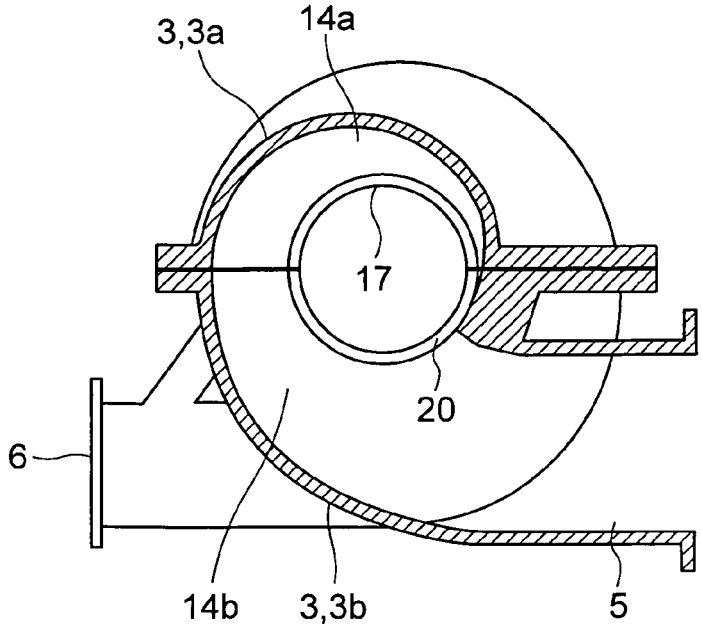
FIG. 8 is a cross-sectional view taken along line X-X in FIG. 1.

FIG. 8 is a cross-sectional view of the volute casings 3*a* and 3*b* in FIG. 1, taken along a line X-X.

The flat face 20 is formed like a disc plate in which there is a circular hole in the circumferential edge 17 of the division plates 14*a* and 14*b* of the upper and lower casing 3*a* and 3*b*. Two disc plates 21*a* and 21*b* as pressure test jigs 12 shown in FIG. 1 are arranged on the right and left sides of the rotary shaft so that they contact the flat faces 20, which are formed around the circumferential edges 17 of the division plates 14*a* and 14*b*, on the side of the suction chambers 7. Then, the two disc plates 21*a* and 21*b* are connected in the axial direction, and are secured in place by a fastening bolt 22. The fastening bolt 22 can also be inserted and fastened from the left suction chamber 7 in FIG. 1.

The assembly processes (1) to (5) for performing the pressure test for the volute casing in FIG. 1 will now be described.

(1) First, the disc plate 21*a* and 21*b* assembly and the fastening bolt 22 are temporarily assembled and mounted on the lower casing 3*b*. (2) Sequentially, thereafter, the upper casing 3*a* is mounted, and flanges 11*a* and 11*b*, on the upper and lower casings 3*a* and 3*b*, are fastened together. (3) Then, the fastening bolt 22 is tightened, through a right shaft seal part 19, until the disc plates 21*a* and 21*b* contact the division plates 14*a* and 14*b* of the upper and lower casings 3*a* and 3*b*, and pressure is applied, from both sides of the shaft toward the center, to the division plates 14*a* and 14*b*. (4) Thereafter, the head of the fastening bolt 22, which by now is fully contained within a counterbored hole formed in the disc plate 21*a*, is sealed in place using a cover 23, bolts 24 for fastening the cover 23 and a gasket 25. (5) And finally, the right and left shaft seal parts 19, the suction port, the discharge port and other holes are closed, tightly sealing the casing.

While referring to FIG. 1, O rings 26 are positioned between the division plates 14*a* and 14*b* and the disc plates 21*a* and 21*b* to provide an improved seal. Thus, since the volute casing and the pressure test jigs are assembled in this manner, the suction chamber side and the discharge chamber side can be completely separated from each other, thereby enabling the performance of a test for which different pressures are employed for suction and discharge. Since different pressures for suction and discharge are employed to conduct the pressure test, the thickness of the casing on the suction chamber 7 side can be reduced, compared with the conventional structure in FIG. 2. That is, in the conventional structure in FIG. 2, the casing on the discharge chamber 8 side is almost as thick as that of the casing on the suction chamber 7 side. On the contrary, in this embodiment, the thickness of the casing on the suction chamber 7 side is much reduced, compared with that of the casing on the discharge chamber 8 side.

One advantage conferred by use of the volute casing in FIG. 1 will be explained hereinafter. The flat faces 20, which serve as sealing faces, are provided at both the right and left sides of the rotary shaft, around the circumferential edges of the semicircular division plates 14*a* and 14*b* that define the suction chambers 7 and the discharge chamber 8 of the volute casing 3. Furthermore, the disc plates 21*a* and 21*b* are closely attached to the flat faces 20, and the O rings 26 are so arranged that they completely separate the suction chamber side from the discharge chamber side. In addition, during the performance of a pressure test, for which different pressures are used for suction and discharge, bending deformation should occur, i.e., the semicircular division plates 14*a* and 14*b*, which define the suction chambers 7 and the discharge chamber 8, should be displaced toward the suction chambers 7, and the semicircular division plates 14*a* and 14*b* will push the two disc plates 21*a* and 21*b* so that they are opened in the axial direction.

Since the fastening bolt 22, which connects the two disc plates 21*a* and 21*b* in the axial direction, absorbs this axial load, the bending deformation of the semicircular division plates 14*a* and 14*b* that define the suction chambers 7 and the discharge chamber 8 can be suppressed, and high pressure fluid leakage from the discharge side to the suction side can be prevented.

In FIG. 1, the fastening bolt 22 is employed as a member for connecting the two disc plates 21*a* and 21*b* in the axial direction; however, a cylindrical or a columnar member may instead be employed. According to the structure in FIG. 1, by tightening in advance the fastening bolt 22, a preload can be imposed on the semicircular division plates 14*a* and 14*b* in a direction opposite to the bending deformation of the suction chamber that may occur as a result of the pressure test. Thus, a more highly effective seal can be provided, and the stress imposed on the division plates 14*a* and 14*b* can be reduced, so that their thicknesses can also be reduced. The fastening bolt 22 is designed to be able to tighten from the suction chamber 7 side. And the cover 23, the bolts 24 for fastening the cover 23 and the gasket 25 are provided as a sealing structure for preventing from the discharge chamber 8 the fluid leakage through the vicinity of the fastening bolt 22. Since the fastening bolt 22 can be tightened from the suction chamber 7 side, the bolt can be tightened before a pressure test is conducted. Thus at this time, to prevent the leakage of fluid around the fastening bolt 22, the sealing structure must be provided for the fastening bolt 22 at the suction chamber 7 side.

Embodiment 2

Figure 9:
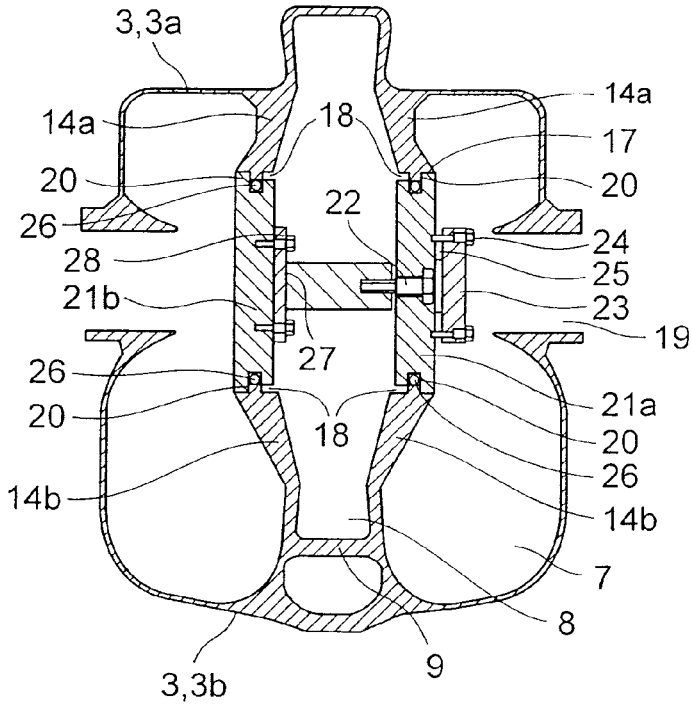
FIG. 9 is a cross-sectional view of the casing of a double suction volute pump for explaining Embodiment 2 of the present invention.

FIG. 9 is a cross-sectional view of a double suction volute pump according to embodiment 2 of the invention.

For the conventional double suction volute pump shown in FIG. 2, in order to secure the casing wearing rings 15, flat faces 18 are formed on the division plates 14*a* and 14*b* at the suction chamber 7 side. In FIG. 9, however, flat faces 20 are formed on division plates 14*a* and 14*b* at a discharge chamber 8 side.

Further, a coupling member 27, a fastening bolt 22 and bolts 28 are employed to connect disc plates 21*a* and 21*b* in the axial direction. For the head portion of the fastening bolt 22, the same seal structure as is shown in FIG. 1 is provided. Furthermore, in FIG. 1, the O rings 26 are sealed by contact with the flat faces 20, while in FIG. 9, O rings 26 are sealed by contact with the inner walls of the division plates 14*a* and 14*b*.

Embodiment 3

Figure 10:
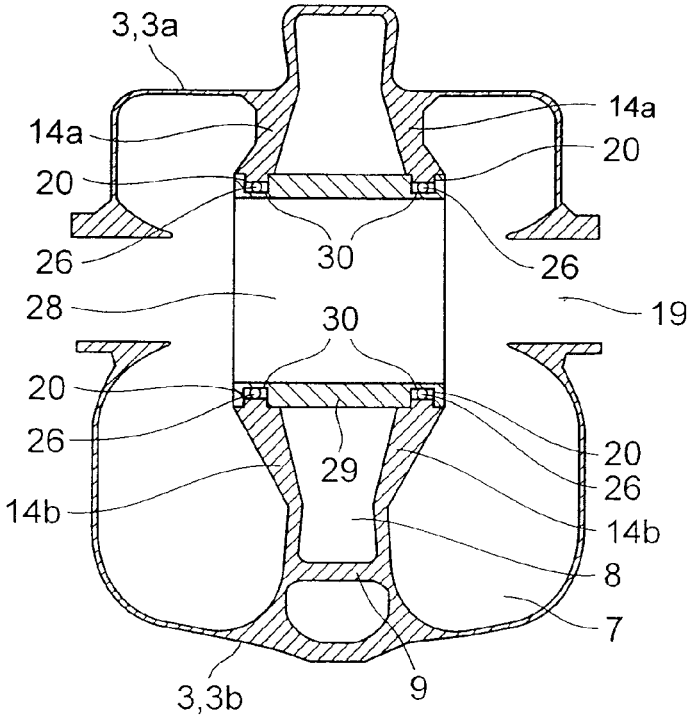
FIG. 10 is a cross-sectional view of the casing of a double suction volute pump for explaining Embodiment 3 of the present invention.
Figure 11:
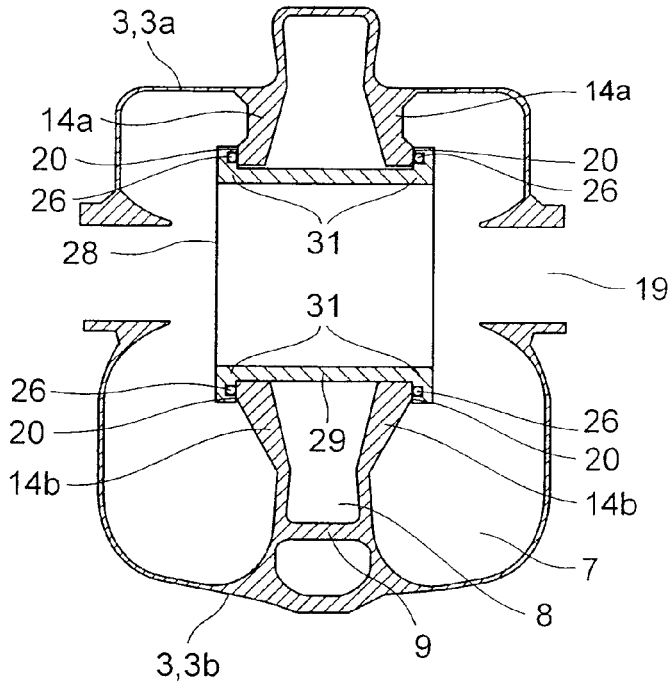
FIG. 11 is a cross-sectional view of the casing of the double suction volute pump for explaining Embodiment 3 of the present invention.

FIGS. 10 and 11 are cross-sectional views of a double suction volute pump according to embodiment 3 of the invention.

In FIGS. 10 and 11, a cylinder 29 is prepared as a pressure test jig, and grooves 30 or flanges 31 are formed on both axial sides of the cylinder 29 so that they contact flat faces 20, formed of semicircular division plates 14*a* and 14*b*, near suction chambers. When a pressure test using different pressures for suction and discharge is conducted by using this cylindrical pressure test jig 29, an axial load is imposed on the cylindrical jig 29, via the grooves 30 or flanges 31 formed in both axial sides, at the time of a bending deformation, i.e., when the semicircular division plates 14*a* and 14*b*, which define suction chambers 7 and a discharge chamber 8, are displaced toward the suction chambers 7. Since the cylindrical jig 29 holds this axial load, deformation of the semicircular division plates 14*a* and 14*b* can be suppressed, and the leakage of high pressure fluid from the discharge side to the suction side can be prevented. Compared with the structure in FIG. 1 which employs the fastening bolt 22, a high size accuracy in the axial direction of the cylindrical jig 29 is required for the structure which employs the cylindrical jig 29 in FIG. 10 or 11.

Embodiment 4

Embodiment 4 of the present invention will now be described while referring to FIGS. 12 and 13.

Figure 12:
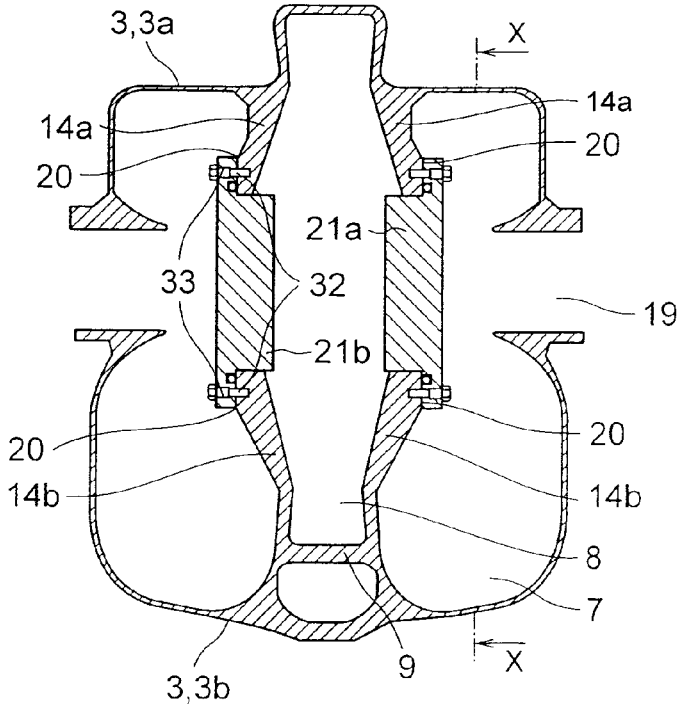
FIG. 12 is a cross-sectional view of the casing of a double suction volute pump for explaining Embodiment 4 of the present invention.

FIG. 12 is a cross-sectional view of a double suction volute pump according to embodiment 4. And FIG. 13 is a cross-sectional view taken along line X-X in FIG. 12.

Figure 13:
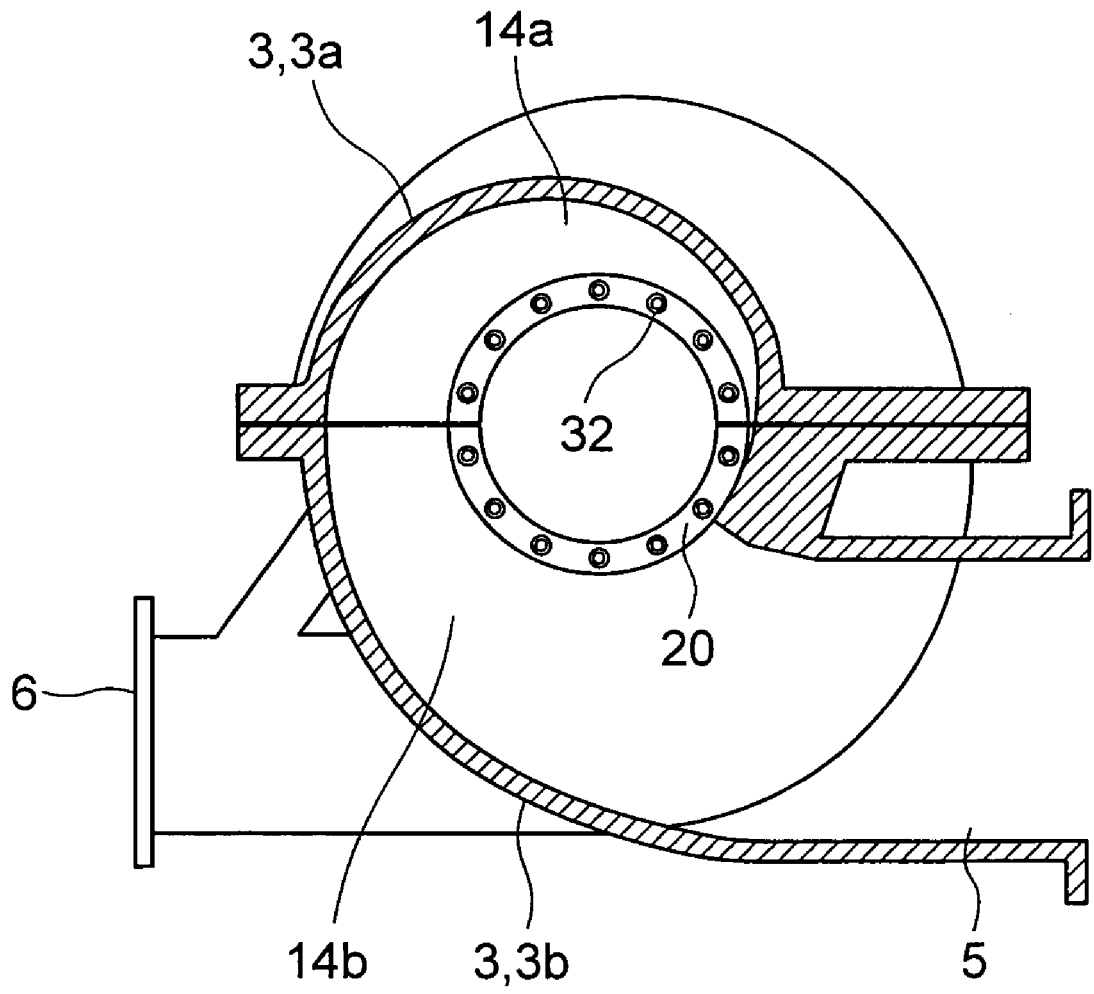
FIG. 13 is a cross-sectional view taken along line X-X in FIG. 12.

In FIGS. 12 and 13, multiple screw holes 32 are formed along the circumference of each flat face 20 formed along the circumferential edges of semicircular division plates 14*a* and 14*b*, which define suction chambers 7 and a discharge chamber 8. Two disc plates or jigs 21*a* and 21*b* are prepared for use for a pressure test, and are secured by tightening bolts 33 inserted into the screw holes 32 formed along the circumferences of the flat faces 20, which are used as sealing faces. According to this structure, since the semicircular division plates 14*a* and 14*b*, which define suction chambers 7 and the discharge chamber 8, are secured to the disc plates 21*a* and 21*b* by the bolts 33, the two semicircular division plates 14*a* and 14*b* and the disc plates 21*a* and 21*b* would be deformed together. Therefore, the leakage of high pressure fluid from the discharge side to the suction side can be prevented. However, after the pressure test has been completed, before the pump is actually operated, the screw holes 32 should be filled with panel screws (headless screws) or a resin, because the pump is operated while the screw holes 32 are open, the deterioration of the hydraulic function will occur. In the embodiment shown in FIGS. 12 and 13, the disc plates 21*a* and 21*b* are not fastened together. However, when these disc plates 21*a* and 21*b* are connected in the axial direction by being fastened together by a bolt, greater effects can be obtained.

With the structures provided in the present invention, a pressure test using different pressures for suction and discharge can be conducted, even when there is a large pressure difference between the suction side and the discharge side. Further, since a pressure test using different pressures for suction and discharge can be performed, the thickness of the casing on the suction chamber side can be much reduced when compared with the thickness on the discharge chamber side. In other words, in order to reduce the thickness on the suction chamber side much more than the thickness on the discharge chamber side, a pressure test using different pressures for suction and discharge is required. In order to conduct such a pressure test, the present invention must be adopted.

As described above, according to the present invention, 1. there is provided a pressure test apparatus, for a double suction volute pump, which includes a horizontally arranged rotary shaft, a double suction centrifugal type impeller for the intake of fluid from both axial directions of the rotary shaft and for the discharge of the fluid to a radial and outer peripheral direction, and a volute casing for enclosing the impeller, wherein the suction chambers are arranged on both sides of the discharge chamber, and wherein the division walls divide the suction chambers and the discharge chamber, and the division wall have circular intake holes for impeller, and wherein the circular intake holes blocked by disc plates or cylindrical jig, and different pressures for suction and discharge are applied in test pressure, and flat faces are formed on the division walls and the disc plates or the cylindrical jig is securely fixed to the flat faces.

2. The disc plates formed in the suction chambers are connected by using coupling members.
3. The members are bolts, which penetrate the discharge chamber.
4. Ring-shaped grooves are formed in the flat faces formed on the division walls, and sealing members are inserted into the grooves.
5. The disk plates are fixed to the flat faces formed on the division walls by screws.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A double suction volute pump comprising:

a horizontally arranged rotary shaft, a discharge chamber located substantially centrally along a length of said rotary shaft, a plurality of suction chambers arranged on both sides of said discharge chamber, a plurality of division walls for dividing said plurality of suction chambers from said discharge chamber, each of said division walls being arranged vertically and including edges facing said rotary shaft, a plurality of flat faces formed on said edges, said flat faces extending vertically, a pair of disc plates forming pressure test members, oriented vertically, contacting said flat faces, and a plurality of seals mounted between said pressure test members and said flat faces.

2. The double suction volute pump according to claim 1, wherein said seals are received in grooves defined in said disc plates.

3. The double suction volute pump according to claim 2, further comprising a fastener extending between the disc plates that secures the disc plates together.

4. The double suction volute pump according to claim 3, wherein said fastener comprises a fastening bolt having a head received in a recess formed in an outer surface of one of said disc plates.

5. The double suction volute pump according to claim 4, further comprising a seal overlying the recess to seal the head of the fastening bolt in place.

6. The double suction volute pump according to claim 5, wherein the seal includes a gasket pressed by a cover against the flat faces.

7. The double suction volute pump according to claim 3, wherein said fastener comprises a fastening bolt having a head received in a recess formed in an outer surface of one of said disc plates.

8. The double suction volute pump according to claim 7, further comprising a seal overlying the recess to seal the head of the fastening bolt in place.

9. The double suction volute pump according to claim 8, wherein the seal includes a gasket pressed by a cover against the flat faces.

10. The double suction volute pump according to claim 1, further comprising a fastener extending between the disc plates that secures the disc plates together.

11. The double suction volute pump according to claim 10, wherein said fastener comprises a fastening bolt having a head received in a recess formed in an outer surface of one of said disc plates.

12. The double suction volute pump according to claim 11, further comprising a seal overlying the recess to seal the head of the fastening bolt in place.

13. The double suction volute pump according to claim 12, wherein the seal includes a gasket pressed by a cover against the flat faces.

* * * * *